US006794610B2

(12) United States Patent
Horey et al.

(10) Patent No.: US 6,794,610 B2
(45) Date of Patent: Sep. 21, 2004

(54) HEATING BLANKETS WITH LOW-CURRENT MULTIPLE HEATING ELEMENTS

(75) Inventors: Leonard I. Horey, Boca Raton, FL (US); Armando Alvite, Miami, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/242,904

(22) Filed: Sep. 10, 2002

(65) Prior Publication Data

US 2003/0047548 A1 Mar. 13, 2003

Related U.S. Application Data

(60) Provisional application No. 60/318,986, filed on Sep. 11, 2001, provisional application No. 60/318,917, filed on Sep. 11, 2001, and provisional application No. 60/318,998, filed on Sep. 11, 2001.

(51) Int. Cl.[7] ..... H05B 1/00

(52) U.S. Cl. ..... 219/212; 219/528; 219/202; 219/211; 219/548; 219/549

(58) Field of Search ..... 219/202–203, 219/205, 211–212, 217, 345, 387, 527–529, 531, 541, 544, 546, 548–549

(56) References Cited

U.S. PATENT DOCUMENTS

| | | | | | |
|---|---|---|---|---|---|
| 3,668,367 | A | * | 6/1972 | Williams | 219/212 |
| 3,721,799 | A | | 3/1973 | Carlstrom | |
| 4,436,986 | A | * | 3/1984 | Carlson | 219/505 |
| 4,533,821 | A | | 8/1985 | Sato | |
| 4,577,094 | A | * | 3/1986 | Mills | 219/505 |
| 4,792,662 | A | | 12/1988 | Kitagaki et al. | |
| 4,983,814 | A | | 1/1991 | Ohgushi et al. | |
| 4,998,006 | A | * | 3/1991 | Perlman | 219/212 |
| 5,298,722 | A | | 3/1994 | Tanaka | |
| 5,422,462 | A | | 6/1995 | Kishimoto | |
| 5,770,836 | A | * | 6/1998 | Weiss | 219/481 |
| 6,160,246 | A | | 12/2000 | Rock et al. | |
| 6,278,085 | B1 | * | 8/2001 | Abukasm | 219/213 |

* cited by examiner

*Primary Examiner*—Shawntina Fuqua
(74) *Attorney, Agent, or Firm*—Lawrence J. Shurupoff

(57) ABSTRACT

A heating blanket reduces the possibility of electrical arcing by providing a series of individual heating elements each carrying a low current.

2 Claims, 4 Drawing Sheets

HEATING BLANKETS WITH LOW-CURRENT MULTIPLE HEATING ELEMENTS

This application claims the benefit of U.S. Provisional Application Ser. No. 60/318,986 filed Sep. 11, 2001, and Provisional Application Ser. No. 60/318,917 filed Sep. 11, 2001, and Provisional Application Ser. No. 60/318,998 filed Sep. 11, 2001.

FIELD OF THE INVENTION

The present invention relates in general to electric heating pads, blankets, pillows, wraps and the like, and in particular to such heating devices which include a plurality of separate low current heating elements.

DESCRIPTION OF PRIOR DEVELOPMENTS

Present day warming blankets use one continuous wire pair which is threaded in a serpentine pattern throughout the blanket. As a result, this single wire pair must carry the entire electrical current of the blanket. As the current in the wire increases, so does the likelihood of an electrical arc occurring should the wire break or crack. Since the blanket current is sufficient to allow an arc to occur if a wire breaks, the blanket control module must contain safety circuitry to determine when this condition occurs. This is necessary, since an arc could potentially damage the blanket. The control module must detect this fault condition and remove electrical power to eliminate this possibility.

SUMMARY OF THE INVENTION

If instead of using one continuous wire pair to construct the blanket, multiple wire pairs were used, then the current in any one wire pair would be low. In this case, if a break occurred in a wire, there would not be enough current to generate an arc. Without the risk of an arc, a break in the wire would not represent a hazard and it would not be necessary to monitor the blanket for this condition. This would simplify the design of the control circuits and thereby reduce cost.

As an alternate design, two wide electrically conductive strips could be used to carry the voltage to multiple PTC heating wires. If the conductive strips were of sufficient size and construction to make breakage virtually impossible, then only the PTC wires would have the possibility of breakage. However, if multiple PTC wires were used, the current in any one PTC wire would be low. Therefore, if a PTC wire broke, there would not be enough current to generate an arc. As with the prior noted design, there would not be a need to monitor for wire breakage.

DETAILED DESCRIPTION OF THE PREFERRED EMBODIMENTS

Figure 1:
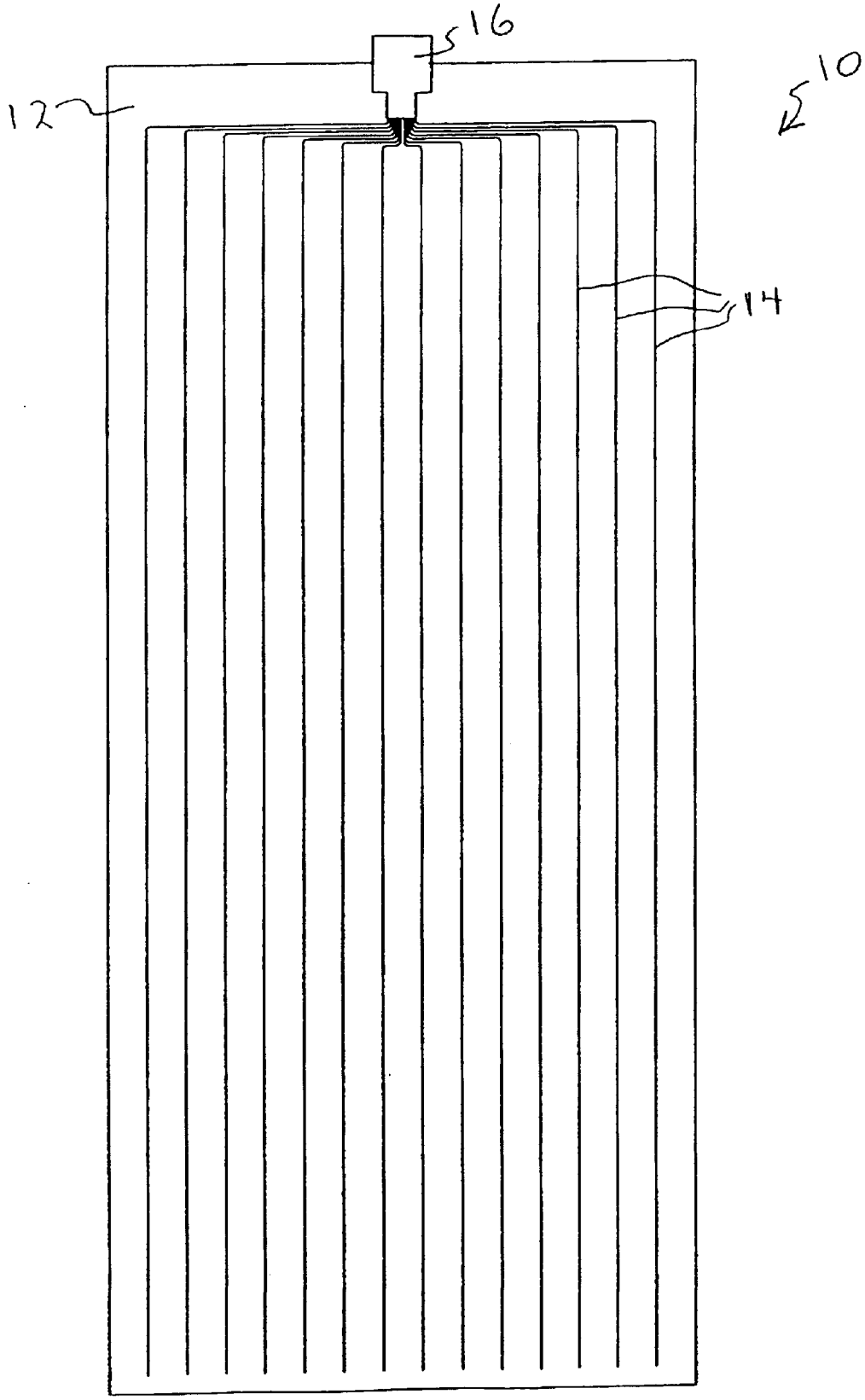
FIG. 1 is a schematic top plan view of a low current electric warming blanket constructed in accordance with the invention wherein multiple heating elements are connected with a common power source.
Figure 2:
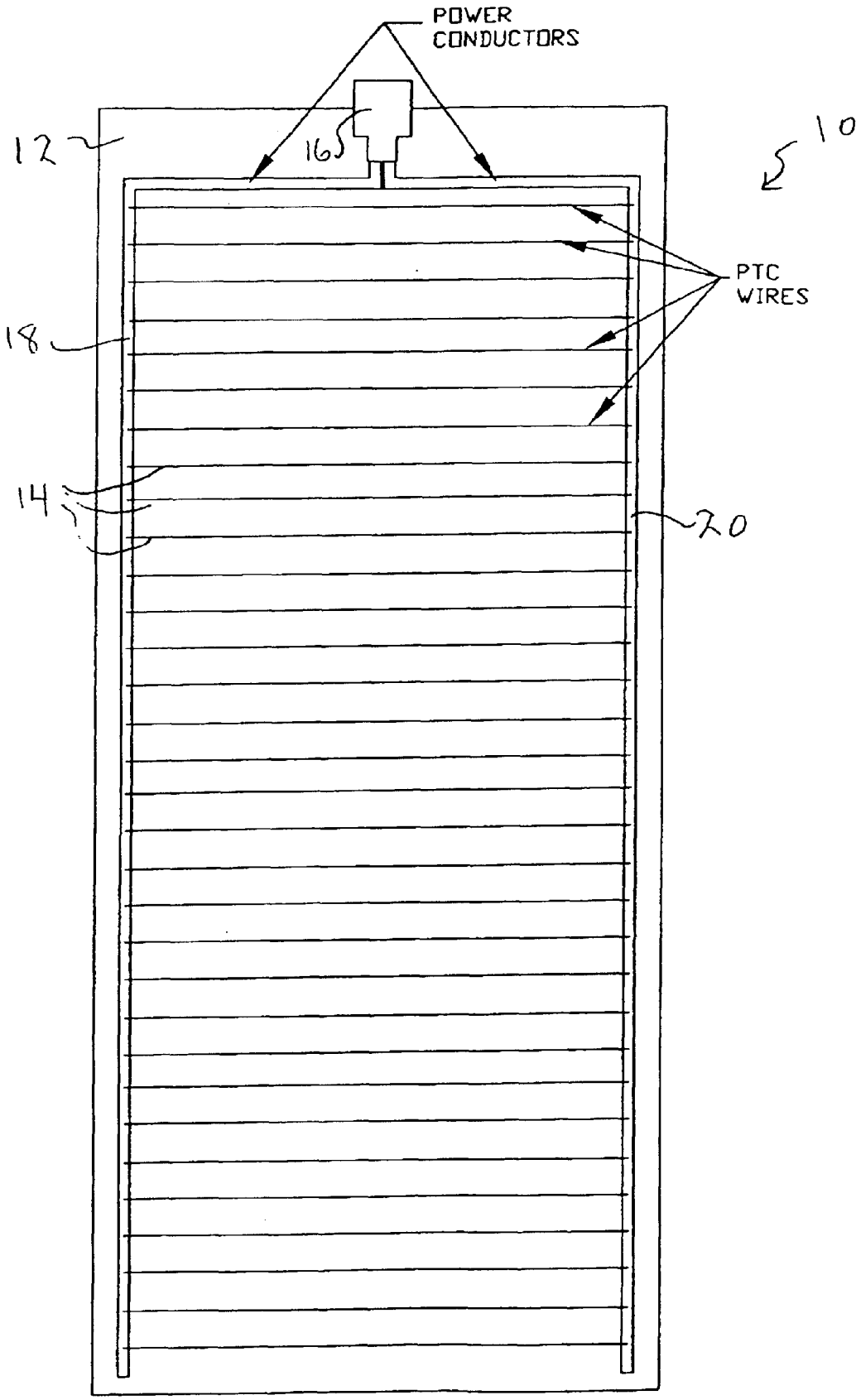
FIG. 2 is a view similar to FIG. 1 illustrating a second embodiment of the invention wherein multiple heating elements are arranged in parallel between a pair of power conductor wires.

A first embodiment of the invention is shown in FIG. 1 wherein an electrical heating assembly 10 is schematically depicted as a heating blanket, pad, pillow or the like. Assembly 10 includes a pliable, flexible outer pocket, cover or shell 12 constructed of a fabric or similar material. Only the bottom half of the cover 12 is shown in FIGS. 1 and 2 for the purpose of showing the details of the heating elements 14 located within the shell 12.

Figure 3:
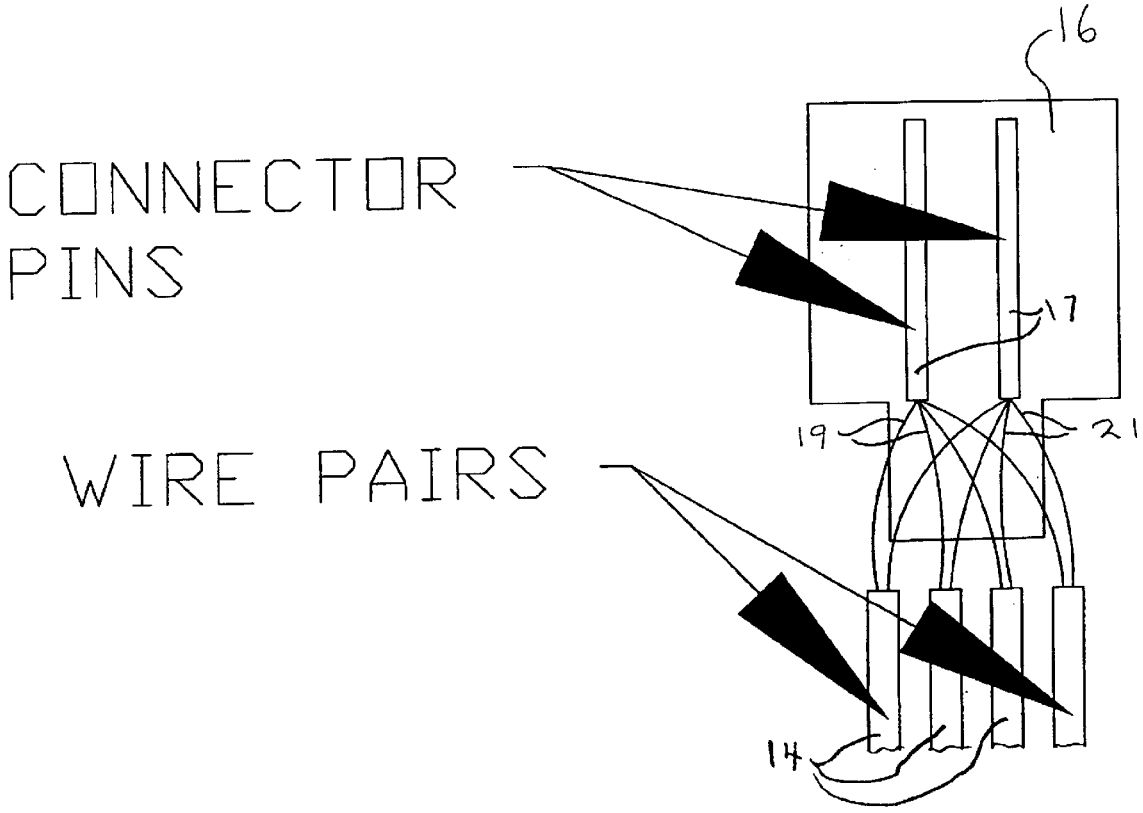
FIG. 3 is a partial schematic view of the connection between the heating elements and connector in FIG. 1.

An electrical connector 16 is adapted to be connected to a power cord which receives electrical power from a standard wall plug. A series of electrical heating elements 14 is connected to the connector 16 for receiving electrical power. Each heating element is connected to the common connector 16 and is preferably wired in parallel with the other heating elements to the common connector 16. As seen in FIG. 3, the connector 16 includes a pair of connector pins 17 feeding power to the heating elements 14 via leads or any other suitable conductors 19, 21.

The heating elements are preferably single lengths of positive temperature coefficient (PTC) heating wire with wire pairs molded within a plastic matrix. However, separate loops of conventional heating wire can be used in place of each PTC wire, if desired. The heating elements 14 are sized to draw relatively low current so that in the event of a crack or break in the wire 14, there is insufficient current available to produce an electric arc. For example, heating elements 14 can be sized to draw 40 ma at 32 volts.

By using a plurality of individual low-current carrying wires or heating elements 14 rather than a single high-current carrying heating wire, the heating assembly 10 can provide heat to a user equal to that of a single heating element heating assembly, but with a much more desirable lower current flowing in each wire.

In FIG. 1, each heating element 14 is connected directly to the electrical connector 16. The heating elements 14 are shown extending in a mutually parallel longitudinally-extending pattern on shell 12, however any suitable pattern can be adopted.

Figure 4:
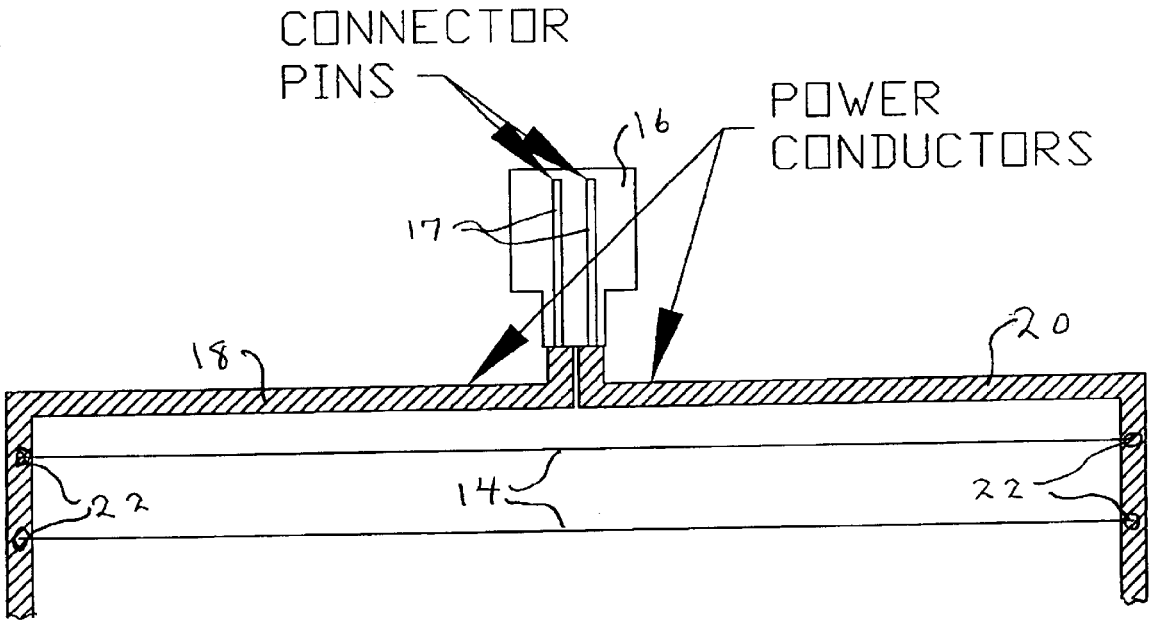
FIG. 4 is a partial schematic view of the connection between the heating elements and connector in FIG. 2.

Another embodiment of the invention is shown in FIG. 2 wherein a pair of electrical conductors 18, 20 is connected to the electrical connector 16 which is attached or otherwise carried by shell 12. One conductor 18 extends longitudinally along one side edge of shell 12 and the other conductor 20 extends longitudinally along the opposite side edge of shell 12. As seen in FIG. 4, each conductor is connected to a pin 17 in connector 16. The heating elements 14 may be crimped, welded or otherwise attached to conductors 18, 20 at connection points 22 in any suitable manner.

A series of transversely-extending individual heating elements 14 is arranged in ladder rung fashion between the conductors 18, 20. The heating elements are wired in parallel electric circuits between the conductors 18, 20. The conductors 18, 20 are preferably formed of a robust insulated wire or strip which is highly resistant to cracking and breaking. Because each individual heating element 14 carries a relatively low current, the risks of electrical arcing due to cracking or breaking of the heating elements 14 may be substantially eliminated.

Although discrete heating wires have been described in the prior examples, the heating element wires can be replaced with metallized fibers or strands woven into the cover or shell 12 in the same patterns as described above, and connected in a similar manner to connector 16. Alternatively, a metallized coating can be applied to the inner surface or surfaces of the blanket shell 12 by spraying or brushing in the manner of a paint coating. The coating can duplicate the pattern of the heating elements discussed above, or may take any other suitable configuration.

What is claimed is:

1. A heating blanket assembly, comprising:

a pliable shell;

a pair of conductors extending along opposites sides of said pliable shell;

an electric connector for carrying current to said conductors; and a plurality of PTC heating elements connected in parallel electric paths between said pair of conductors, said PTC heating elements comprising individual lengths of PTC wire each comprising wire pairs within a plastic matrix, and wherein said PTC heating elements are sized to draw sufficiently low current so that in the event of a crack or break in said PTC heating elements, there is insufficient current available to produce an electrical arc.

2. The assembly of claim 1, wherein said PTC heating elements are sized so as to draw about 40 ma at 32 volts.

* * * * *